US009217978B2

(12) United States Patent
Ikeda

(10) Patent No.: US 9,217,978 B2
(45) Date of Patent: Dec. 22, 2015

(54) IMAGE FORMING APPARATUS CONFIGURED TO CONTROL A CONVEYANCE SPEED OF THE SHEET TO ACCELERATE AND/OR DECELERATE WITHOUT STOPPING THE SHEET IN A SECTION BETWEEN A PAPER FEED UNIT AND A TRANSFER UNIT

(75) Inventor: Yoshimichi Ikeda, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 1081 days.

(21) Appl. No.: 12/056,972

(22) Filed: Mar. 27, 2008

(65) Prior Publication Data

US 2008/0260444 A1 Oct. 23, 2008

(30) Foreign Application Priority Data

Apr. 20, 2007 (JP) ..... 2007-111933

(51) Int. Cl.
*G03G 15/00* (2006.01)

(52) U.S. Cl.
CPC .. *G03G 15/6564* (2013.01); *G03G 2215/00599* (2013.01); *G03G 2215/00945* (2013.01); *G03G 2215/00949* (2013.01); *G03G 2215/0132* (2013.01); *G03G 2215/0154* (2013.01)

(58) Field of Classification Search
CPC ..... B65H 2513/10; B65H 2513/51; G03G 15/6564
USPC ..... 399/396, 391, 388, 394, 66; 271/264, 271/265.01; 400/624
See application file for complete search history.

(56) References Cited

U.S. PATENT DOCUMENTS

| | | | | |
|---|---|---|---|---|
| 6,014,542 | A * | 1/2000 | Hozumi et al. | 399/394 |
| 6,208,831 | B1 | 3/2001 | Amano | |
| 6,519,443 | B1 * | 2/2003 | Coriale et al. | 399/388 |
| 6,920,308 | B2 * | 7/2005 | Demchock et al. | 399/396 |
| 7,050,746 | B2 | 5/2006 | Hirai et al. | |
| 7,929,870 | B2 * | 4/2011 | Aratake et al. | 399/27 |
| 2003/0043418 | A1 * | 3/2003 | Tsutsumi | 358/412 |
| 2003/0231914 | A1 * | 12/2003 | Yasui | 399/396 |
| 2004/0217538 | A1 * | 11/2004 | Kawamura | 271/9.01 |

FOREIGN PATENT DOCUMENTS

| | | | |
|---|---|---|---|
| JP | 6-208262 | A | 7/1994 |
| JP | 11-249525 | A | 9/1999 |
| JP | 2001-233478 | A | 8/2001 |
| JP | 2002-326741 | A | 11/2002 |
| JP | 2004-258106 | A | 9/2004 |
| JP | 2004-333609 | A | 11/2004 |
| JP | 2007-328045 | A | 12/2007 |

* cited by examiner

*Primary Examiner* — Matthew G Marini
(74) *Attorney, Agent, or Firm* — Canon USA, Inc. IP Division

(57) ABSTRACT

An image forming apparatus capable of setting a plurality of image forming speeds includes a transfer unit configured to transfer an image formed on an image carrier onto a sheet, a paper feed unit configured to feed the sheet, and a control unit configured to control the conveyance speed of the sheet to accelerate and decelerate without stopping the sheet in a section between the paper feed unit and the transfer unit to synchronize the sheet with the image formed on the image carrier. The control unit changes paper feed timing from the paper feed unit according to the image forming speed if the image forming speed is predetermined.

9 Claims, 11 Drawing Sheets

(a) $\alpha = \beta = 0$ms

| | NORMAL SPEED | DECELERATED SPEED | ACCELERATED SPEED |
|---|---|---|---|
| MAXIMUM PROCESSING SPEED (MOTOR DRIVING FREQUENCY) | 200mm/s (1000pps) | – (–) | 240mm/s (1200pps) |
| MINIMUM PROCESSING SPEED (MOTOR DRIVING FREQUENCY) | 50mm/s (250pps) | 40mm/s (200pps) | – (–) |

(b) $\alpha = 50$ms、$\beta = 300$ms

| | NORMAL SPEED | DECELERATED SPEED | ACCELERATED SPEED |
|---|---|---|---|
| MAXIMUM PROCESSING SPEED (MOTOR DRIVING FREQUENCY) | 200mm/s (1000pps) | – (–) | 218mm/s (1091pps) |
| MINIMUM PROCESSING SPEED (MOTOR DRIVING FREQUENCY) | 50mm/s (250pps) | 44mm/s (222pps) | – (–) |

(c) $\alpha = 100$ms、$\beta = 600$ms

| | NORMAL SPEED | DECELERATED SPEED | ACCELERATED SPEED |
|---|---|---|---|
| MAXIMUM PROCESSING SPEED (MOTOR DRIVING FREQUENCY) | 200mm/s (1000pps) | – (–) | 200mm/s (1000pps) |
| MINIMUM PROCESSING SPEED (MOTOR DRIVING FREQUENCY) | 50mm/s (250pps) | 50mm/s (250pps) | – (–) |

FIG. 6

(a) $\alpha = \beta = 0$ms

| | NORMAL SPEED | DECELERATED SPEED | ACCELERATED SPEED |
|---|---|---|---|
| MAXIMUM PROCESSING SPEED (MOTOR DRIVING FREQUENCY) | 200mm/s (1000pps) | — (—) | 240mm/s (1200pps) |
| MINIMUM PROCESSING SPEED (MOTOR DRIVING FREQUENCY) | 50mm/s (250pps) | 40mm/s (200pps) | — (—) |

(b) $\alpha = 50$ms、$\beta = 300$ms

| | NORMAL SPEED | DECELERATED SPEED | ACCELERATED SPEED |
|---|---|---|---|
| MAXIMUM PROCESSING SPEED (MOTOR DRIVING FREQUENCY) | 200mm/s (1000pps) | — (—) | 218mm/s (1091pps) |
| MINIMUM PROCESSING SPEED (MOTOR DRIVING FREQUENCY) | 50mm/s (250pps) | 44mm/s (222pps) | — (—) |

(c) $\alpha = 100$ms、$\beta = 600$ms

| | NORMAL SPEED | DECELERATED SPEED | ACCELERATED SPEED |
|---|---|---|---|
| MAXIMUM PROCESSING SPEED (MOTOR DRIVING FREQUENCY) | 200mm/s (1000pps) | — (—) | 200mm/s (1000pps) |
| MINIMUM PROCESSING SPEED (MOTOR DRIVING FREQUENCY) | 50mm/s (250pps) | 50mm/s (250pps) | — (—) |

FIG. 8

(a) $\alpha$ =0ms

| | NORMAL SPEED | DECELERATED SPEED | ACCELERATED SPEED |
|---|---|---|---|
| MAXIMUM PROCESSING SPEED (MOTOR DRIVING FREQUENCY) | 200mm/s (1000pps) | — (—) | 240mm/s (1200pps) |
| MINIMUM PROCESSING SPEED (MOTOR DRIVING FREQUENCY) | 50mm/s (250pps) | 40mm/s (200pps) | — (—) |

(b) $\alpha$ =50ms

| | NORMAL SPEED | DECELERATED SPEED | ACCELERATED SPEED |
|---|---|---|---|
| MAXIMUM PROCESSING SPEED (MOTOR DRIVING FREQUENCY) | 200mm/s (1000pps) | — (—) | 218mm/s (1091pps) |
| MINIMUM PROCESSING SPEED (MOTOR DRIVING FREQUENCY) | 50mm/s (250pps) | — (—) | — (—) |

(c) $\alpha$ =100ms

| | NORMAL SPEED | DECELERATED SPEED | ACCELERATED SPEED |
|---|---|---|---|
| MAXIMUM PROCESSING SPEED (MOTOR DRIVING FREQUENCY) | 200mm/s (1000pps) | — (—) | 200mm/s (1000pps) |
| MINIMUM PROCESSING SPEED (MOTOR DRIVING FREQUENCY) | 50mm/s (250pps) | — (—) | — (—) |

FIG. 9

| | PRINTER PAPER | TIME INTERVAL BETWEEN END OF PAPER AND TOP OF SUBSEQUENT PAPER | MOTOR STOP TIME | PRINTING EFFICIENCY |
|---|---|---|---|---|
| MAXIMUM PROCESSING SPEED 200mm/s (MOTOR STOP: NO) | 1.5s (300mm) | 0.5s (100mm) | 0s (0mm) | 30 PAGES/MIN |
| MAXIMUM PROCESSING SPEED 200mm/s (MOTOR STOP: YES) | 1.5s (300mm) | 0.5s (100mm) | 0.1s (20mm) | 28.5 PAGES/MIN |
| MINIMUM PROCESSING SPEED 50mm/s (MOTOR STOP: NO) | 6s (300mm) | 2s (100mm) | 0s (0mm) | 7.5 PAGES/MIN |
| MINIMUM PROCESSING SPEED 50mm/s (MOTOR STOP: YES) | 6s (300mm) | 2s (100mm) | 0.1s (20mm) | 7.4 PAGES/MIN |

IMAGE FORMING APPARATUS CONFIGURED TO CONTROL A CONVEYANCE SPEED OF THE SHEET TO ACCELERATE AND/OR DECELERATE WITHOUT STOPPING THE SHEET IN A SECTION BETWEEN A PAPER FEED UNIT AND A TRANSFER UNIT

BACKGROUND OF THE INVENTION

1. Field of the Invention

The present invention relates to an image forming apparatus such as a laser printer or a copier. More particularly, the present invention relates to an alignment of a sheet with an image of an intermediate-transfer-type image forming apparatus which starts an image forming operation before a paper feed operation.

2. Description of the Related Art

In a conventional image forming method for an apparatus such as a color laser printer or a color copier, images which are formed by toner of each of four colors (Y: yellow, M: magenta, C: cyan, and K: black) are sequentially formed on a single photosensitive member as an image carrier. The images carried by the photosensitive member are sequentially transferred to a transfer member such as an intermediate transfer member to be superposed, and then transferred to a sheet. A disadvantage of this method is that a considerable amount of time is required in forming the full color image on the sheet.

In recent years, a color laser printer having a plurality of photosensitive members serving as image carriers has been developed to meet the demand for higher image-forming speed. In such a color laser printer, an optical apparatus scans independently scans a surface of each photosensitive member with each of a plurality of light beams to form an image in each CMYK color. The color images are superposed on an intermediate transfer belt and finally transferred onto a sheet to form a color image. This is called an intermediate transfer system (hereinafter referred to as tandem type). A tandem type laser printer performs image forming with a plurality of colors (4 colors) using a plurality of photosensitive members at the same time. Accordingly, the time for forming the color image on a sheet can be significantly reduced compared to the aforementioned method.

Next, a specific configuration and movement of the tandem type laser printer will be described referring to FIG. 1. First, laser scanners 11Y, 11M, 11C, and 11K emit a laser beam onto a surface of photosensitive members 13Y, 13M, 13C, and 13K which is charged by charge rollers 15Y, 15M, 15C, and 15K to form an electrostatic latent image. Next, development units 16Y, 16M, 16C, and 16K cause toner to adhere to the electrostatic latent image to visualize the image. The toner adhering to the photosensitive members 13Y, 13M, 13C, and 13K is sequentially superposed on an intermediate transfer belt 17 to form a color toner image.

On the other hand, a sheet 21 in a cassette 22 is fed by a feeding roller 25 at such timing that the sheet 21 matches a toner image on the intermediate transfer belt 17 at a secondary transfer roller 29. Then, the sheet 21 is conveyed by a conveyance roller pair 27 to the secondary transfer roller 29. A full-color toner image on the intermediate transfer belt 17 is transferred to the sheet 21 by the secondary transfer roller 29. The full-color toner image is fixed to the sheet 21 by a fixing unit 30 and a full-color printed matter is produced.

However, when the sheet 21 is aligned with the toner image, the sheet 21 is occasionally double-fed to a position where separation rollers 26*a* and 26*b* are arranged due to friction or static electricity, etc. between the top sheet and the next sheet in the cassette 22. In this case, the distance from the sheet 21 to the secondary transfer roller 29 where the image is transferred becomes short, and occasionally, the sheet 21 reaches the transfer position on the secondary transfer roller 29 earlier than the image on the intermediate transfer belt 17 is conveyed to the secondary transfer roller 29. Further, in some cases, a slip of the feeding roller 25 delays the sheet 21, which reaches the transfer position at the secondary transfer roller 29 later than the image on the intermediate transfer belt 17 is conveyed to the secondary transfer roller 29. These cases cause misalignment of the toner image and the sheet 21.

In order to solve this problem, Japanese Patent Application Laid-Open No. 11-249525, for example, discusses a method for aligning a sheet with a toner image regardless of a double feeding of the sheet in a cassette or a slip of the feeding roller.

FIG. 10 illustrates an example of a conventional technique in which conveying of the sheet 21 is temporarily stopped to align with the toner image. A thick line in FIG. 10 is a plot of a Y image which is formed on a photosensitive drum disposed at the most upstream side of the intermediate transfer belt 17. The Y image is a yellow primary image that is first transferred to the intermediate transfer belt 17. Areas shaded with vertical lines show that the sheet 21 is fed at timing earlier than desired timing. More specifically, these areas show a positional change of the sheet 21 when double feeding of the sheet 21 occurs in the cassette 22. On the other hand, areas shaded with horizontal lines show that the sheet 21 is fed at timing later than desired timing. More specifically, these areas show a positional change of the sheet 21 when a slip of the feeding roller 25 occurs in the cassette 22.

Generally, in the tandem type using the intermediate transfer belt 17, the image forming is started before the paper feed operation from the cassette 22. When printing is instructed, the image forming on each photosensitive member is started in an order from the Y image whose photosensitive member is disposed at the most upstream side of the intermediate transfer belt 17, the M image, the C image, to the K image. Then each image formed on the corresponding photosensitive member is transferred onto the intermediate transfer belt 17 in the order of Y, M, C, and K. In the meantime, the sheet 21 is fed from the cassette 22 at timing earlier than when the toner image is formed on the intermediate transfer belt 17.

The sheet 21 fed from the cassette 22 is conveyed by the conveyance roller pair 27. When the sensor 28 detects the sheet 21, the conveyance of the sheet 21 is stopped. A conveyance time of the sheet 21 from starting the paper feed from the cassette 22 until detecting the sheet 21 by the sensor 28 is measured in advance. A stop time of the conveyance of the sheet 21 is calculated according to the conveyance time. The conveyance of the sheet 21 is restarted after the calculated stop time. In this way, the sheet 21 is aligned with the toner image on the intermediate transfer belt 17, or in other words, the leading edge of the sheet 21 is aligned with the top of the toner image.

According to a configuration of the image forming apparatus, a stepping motor 45, which facilitates control of position and speed in an open loop control system, is used for driving the feeding roller 25 and the conveyance roller pair 27. The stepping motor 45 has a characteristic that it tends to step out if it is restarted before vibration generated by stoppage is not sufficiently reduced. Thus, the stepping motor 45 requires a relatively long stop time until the vibration is sufficiently reduced.

Thus, the conveyance of the sheet 21 needs to be stopped until the vibration of the stepping motor 45 is sufficiently reduced even in the case where the feeding roller 25 whose stop time is the shortest, slips. If the sheet 21 is stopped for a longer time, the paper feed interval increases and throughput is reduced. In order not to reduce the number of sheets printed per unit time, processing speed needs to be increased. This can be achieved by increasing a speed of the stepping motor or by adjusting image forming conditions, which may, however, increase the cost or complicate a control system.

In these days, the sheet 21 is aligned with the toner image on the intermediate transfer belt 17 without stopping the sheet 21. This technique is, for example, discussed in Japanese Patent Application Laid-Open No. 2004-333609. FIG. 11 illustrates an example of a conventional technique in which the sheet 21 is continuously conveyed to the position where it is aligned with the toner image. As described referring to FIG. 10, the thick line is a plot of the Y image which is formed on the photosensitive drum disposed at the most upstream side of the intermediate transfer belt 17. The areas shaded with vertical lines show that the sheet 21 is fed at timing earlier than desired timing. More specifically, these areas show a position of the sheet 21 when double feeding of the sheet 21 occurs in the cassette 22. Further, the areas shaded with horizontal lines show that the sheet 21 is fed at timing later than desired timing. More specifically, these areas show a position of the sheet 21 when a slip of the feeding roller 25 occurs in the cassette 22.

When printing is instructed, the image forming on each photosensitive member is started in an order from the Y image whose photosensitive member is disposed at the most upstream side of the intermediate transfer belt 17, the M image, the C image, to the K image. Then each image formed on the corresponding photosensitive member is transferred onto the intermediate transfer belt 17 in the order of Y, M, C, and K. In the meantime, the sheet 21 is fed from the cassette 22 at timing that is ideal for the alignment of the leading edge of the sheet 21 with the top of the toner image. The sheet 21 is conveyed by the conveyance roller pair 27 and detected by the sensor 28.

A conveyance time of the sheet 21 from starting the paper feed from the cassette 22 until detecting the sheet 21 by the sensor 28 is measured in advance. According to the conveyance time, the conveyance speed of the sheet 21 is accelerated or decelerated until the sheet 21 is conveyed to a predetermined control end point at the upstream of the secondary transfer roller 29 where the sheet 21 is aligned with the toner image. When the sheet 21 is conveyed to the control end point, the conveyance speed is reset to a predetermined constant speed. This technique eliminates the need for temporarily stopping the stepping motor 45 which drives the feeding roller 25 and the conveyance roller pair 27 and thus contributes to reducing the paper feed interval and preventing decrease of throughput. In addition, this technique can improve printing efficiency without increasing the processing speed.

Further, the image forming apparatus may set a plurality of processing speeds according to a type of the sheet 21. It is known that a fixing capability of the sheet 21 depends on its thickness, material, and surface smoothness. For example, a thick sheet tends to absorb more heat from the fixing unit 30 than a plain sheet or a sheet which is thinner than the thick sheet. Thus, in order to melt the toner sufficiently and firmly fix the image on a thick sheet, the thick sheet needs to pass through the fixing unit 30 at a slow speed.

In this case, fixing the image can be enhanced by conveying the sheet 21 with slower speed while it passes through the fixing unit 30. This technique is discussed in Japanese Patent Application Laid-Open No. 6-208262. However, according to the configuration of the image forming apparatus, the sheet 21 may be conveyed not only by the fixing unit 30 but also by the secondary transfer roller 29 or the conveyance roller pair 27. Accordingly, a speed (conveyance speed of sheet) of the whole process of the image forming apparatus including the image forming unit but excluding the fixing unit needs to be decreased.

Japanese Patent Application Laid-Open No. 11-249525 discusses a technique for detecting a delay in the paper feed and accelerating the conveyance speed in order to make up for the time delayed. Further, Japanese Patent Application Laid-Open No. 2004-333609 discusses a technique for correcting a variation of a pick-up time of a feed unit, by which a sheet can be fed without stopping the conveyance of the sheet.

However, the conventional image forming apparatuses described above have the following problems.

In a case a plurality of processing speeds are used according to a type of the sheet, the conveyance speed of the sheet 21 is accelerated or decelerated so that the sheet 21 is aligned with the toner image without stopping the conveyance of the sheet 21. In such a case, a speed adjustment range (a setting range of the drive frequency) of the stepping motor 45 which drives the feeding roller 25 and the conveyance roller pair 27 increases.

For example, if a processing speed of a thick sheet 21 is ¼ of a processing speed for a plain sheet (normal processing speed), the drive frequency of the stepping motor 45 driving the feeding roller 25 and the conveyance roller pair 27 is 1000 pulse per second (pps) for the plain sheet and 250 pps for the thick sheet 21, and furthermore, if a change rate of the conveyance speed necessary in aligning the sheet 21 with the toner image is ±20%, the total drive frequency of the stepping motor 45 which drives the feeding roller 25 and the conveyance roller pair 27 will range from 200 to 1200 pps, which is considerably wide.

Generally, the stepping motor 45 tends to generate vibration and noise at a lower speed drive and step out due to low torque at a higher speed. If a vibration absorber or a larger stepping motor 45 is used to cope with the above-mentioned characteristics, the cost of the image forming apparatus will be increased.

SUMMARY OF THE INVENTION

The present invention is directed to an image forming apparatus which can align a sheet with a toner image without temporarily stopping sheet conveyance and without increasing a cost of a motor.

More particularly, the present invention is directed to an image forming apparatus which can convey a sheet which is fed out without temporarily stopping the sheet conveyance and align the sheet with a toner image without adding a member to reduce vibration and noise of a motor or using a larger motor having a wide range of speed adjustment, and thus can avoid cost increase of the image forming apparatus.

According to an aspect of the present invention, an image forming apparatus includes a transfer unit configured to transfer an image formed on an image carrier onto a sheet and a paper feed unit configured to feed the sheet and capable of setting a plurality of image forming speeds used in forming the image on the sheet, accelerating and decelerating a conveyance speed of the sheet without stopping the conveyance of the sheet in a section between the paper feed unit and the transfer unit in order to synchronize the sheet with the image formed on the image carrier and further includes a conveyance unit configured to convey the sheet fed from the paper feed unit to the transfer unit and a control unit configured to control paper feed timing from the paper feed unit. If the image is formed at a first image forming speed which is a fastest or at a second image forming speed which is a slowest of the plurality of image forming speeds, the control unit feeds the sheet at timing different from the paper feed timing when the sheet is fed at the image forming speed other than the first and the second image forming speeds.

According to another aspect of the present invention, an image forming apparatus capable of setting a plurality of image forming speeds includes a transfer unit configured to transfer the image formed on an image carrier onto the sheet, a paper feed unit configured to feed the sheet, and a control unit configured to control a conveyance speed of the sheet to accelerate and decelerate without stopping the sheet in a section between the paper feed unit and the transfer unit to synchronize the sheet with the image formed on the image carrier. The control unit changes paper feed timing from the paper feed unit according to the image forming speed if the image forming speed is predetermined.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 6 illustrates examples of speed adjustment ranges of a registration roller and a stepping motor according to a third exemplary embodiment of the present invention.

FIG. 8 illustrates examples of speed adjustment ranges of a registration roller and a stepping motor according to the fourth exemplary embodiment of the present invention.

FIG. 9 illustrates examples of relations between a stoppage of the stepping motor and printing efficiency according to the fourth exemplary embodiment of the present invention.

DETAILED DESCRIPTION OF THE EMBODIMENTS

Various exemplary embodiments, features, and aspects of the invention will be described in detail below with reference to the drawings.

First Exemplary Embodiment

Figure 1:
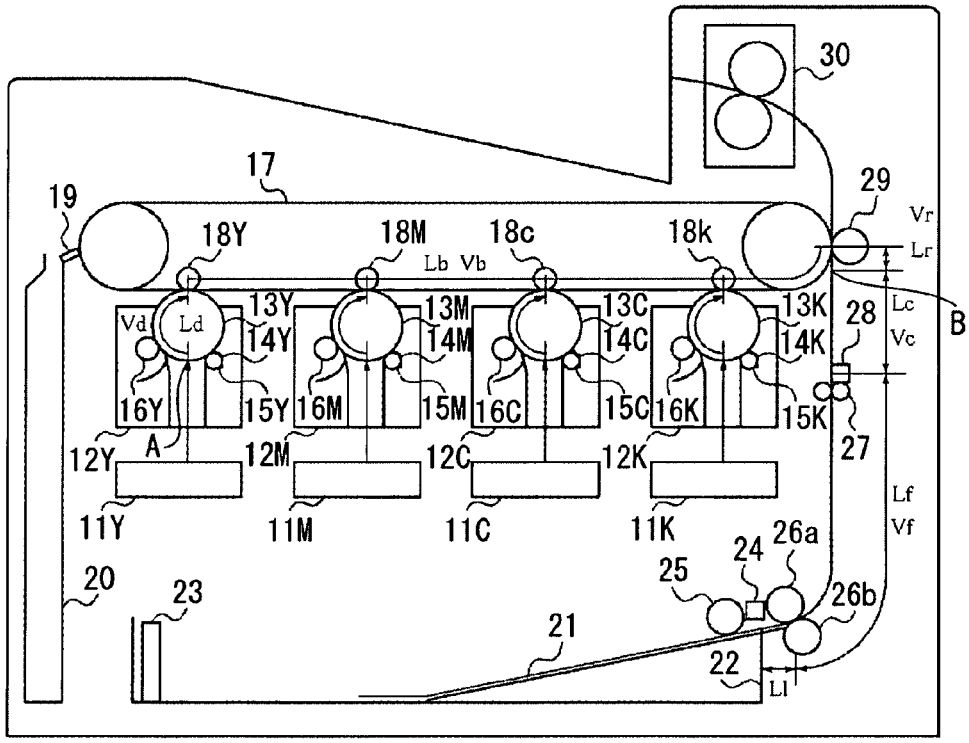
FIG. 1 illustrates an overall configuration of a tandem-type color image forming apparatus according to an exemplary embodiment of the present invention.

FIG. 1 illustrates an overall configuration of a tandem-type color image forming apparatus according to a first exemplary embodiment of the present invention. First, the configuration of the image forming apparatus will be described referring to FIG. 1.

The tandem-type color image forming apparatus is configured to output a full-color image by superposing images formed by toners of four colors yellow (Y), magenta (M), cyan (C), and black (K). The tandem-type color image forming apparatus includes laser scanners 11Y, 11M, 11C, and 11K and cartridges 12Y, 12M, 12C, and 12K used for forming the image in each color. The cartridges 12Y, 12M, 12C, and 12K include photosensitive members 13Y, 13M, 13C, and 13K which rotate in the direction of the arrow in FIG. 1, photosensitive member cleaners 14Y, 14M, 14C, and 14K which contact the photosensitive members 13Y, 13M, 13C, and 13K, charge rollers 15Y, 15M, 15C, and 15K, and development units 16Y, 16M, 16C, and 16K.

Further, each of the photosensitive members 13Y, 13M, 13C, and 13K is arranged to contact the intermediate transfer belt 17, and each of primary transfer rollers 18Y, 18M, 18C, and 18K is located at a position facing each of the photosensitive members 13Y, 13M, 13C, and 13K across the intermediate transfer belt 17. Furthermore, a belt cleaner 19 for recovering toner remaining on the intermediate transfer belt 17 is provided on the intermediate transfer belt 17. A waste toner bin 20 is also provided to store waste toner collected by the belt cleaner 19.

The cassette 22 for storing the sheet 21 includes a guide 23 which limits a position of the sheet 21 in the cassette 22 and a paper detection sensor 24 which detects a presence of the sheet 21 in the cassette 22. A feeding roller 25, a separation roller pair 26*a* and 26*b*, and a conveyance roller pair 27 are arranged along a conveyance path of the sheet 21. A sensor 28 is arranged in the vicinity of the conveyance roller pair 27 on the downstream side in the paper conveying direction. A secondary transfer roller 29 is located so as to contact the intermediate transfer belt 17. A fixing unit 30 is arranged at a stage subsequent to the secondary transfer roller 29. Each of the laser scanners 11Y, 11M, 11C, and 11K includes members such as a laser light emitting element and a polygonal mirror (not shown). Since these members have a known configuration, their descriptions are omitted.

Next, an electrophotographic process will be described. First, a surface of each of the photosensitive members 13Y, 13M, 13C, and 13K is evenly charged by each of the charge rollers 15Y, 15M, 15C, and 15K in each of the cartridges 12Y, 12M, 12C, and 12K. Next, the laser scanners 11Y, 11M, 11C, and 11K irradiate a surface of each of the photosensitive members 13Y, 13M, 13C, and 13K with laser beams modulated according to the image data. An electrostatic latent image is formed on the surface area of each of the photosensitive members 13Y, 13M, 13C, and 13K since the laser beams remove the electrical charge on a part irradiated therewith. Each of development units 16Y, 16M, 16C, and 16K causes charged toner adhere to the electrostatic latent image formed on the surface of each of the photosensitive members 13Y, 13M, 13C, and 13K to form a toner image of each color on the surface of each of the photosensitive members 13Y, 13M, 13C, and 13K. Further, the toner image formed on the surface of each of the photosensitive members 13Y, 13M, 13C, and 13K is transferred to the intermediate transfer belt 17 in a superposed manner by the primary transfer rollers 18Y, 18M, 18C, and 18K.

The above-described laser scanners, photosensitive members, charge rollers, and development units constitute the image forming unit of the color image forming apparatus. The photosensitive members are charged with a predetermined potential by the charge rollers and latent images are formed by the laser scanners. The latent images are developed by the development units and images are formed on the photosensitive members.

On the other hand, the sheet 21 in the cassette 22 is fed by the feeding roller 25. Even if a plurality of sheets 21 is fed from the cassette 22, only one sheet is conveyed to the conveyance roller pair 27 by the separation roller pair 26*a* and 26*b*. Subsequently, the toner image on the intermediate transfer belt 17 is transferred to the sheet 21 by the secondary transfer roller 29. Finally, the toner image on the sheet 21 is fixed by the fixing unit 30 and discharged outside of the image forming apparatus.

Figure 2:
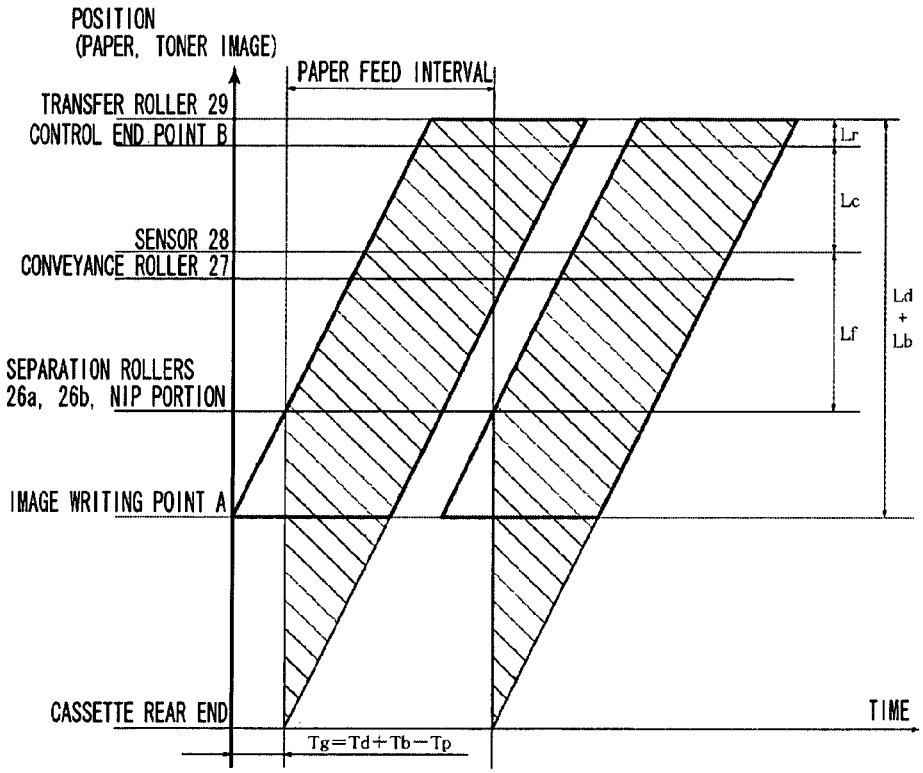
FIG. 2 illustrates an example alignment of a sheet with a toner image according to an exemplary embodiment of the present invention.

Next, the alignment of the toner image with the sheet 21 will be described referring to FIGS. 1 and 2. FIG. 2 illustrates the alignment of the sheet 21 with a toner image. Here, only timing of an image forming in the cartridge 12Y and conveyance timing of the sheet 21 is described. The cartridge 12Y is arranged at the farthest position from where the toner image is transferred to the sheet 21 by the secondary transfer roller 29. Description of the rest of the cartridges (12M, 12C, 12K) will be omitted.

The vertical axis in FIG. 2 represents a position of the paper from the start of the conveyance until the toner image is transferred to the sheet by the transfer roller. A position of the cassette-rear-end on the vertical axis shows a trailing edge of the sheet 21, which is set in the cassette, in the conveying direction. Further, a point A is a point to start image writing and a point B is the control end point in FIG. 1. A nip portion of the separation rollers 26*a* and 26*b*, the conveyance roller pair 27, the sensor 28, and the secondary transfer roller 29 are located as shown in FIG. 1. The horizontal axis in FIG. 2 represents time.

In FIG. 2, the paper feed interval is defined as a time from when a first sheet is conveyed to the nip portion of the separation roller pair 26*a* and 26*b* till a next sheet is conveyed to the nip portion. Further, according to the present exemplary embodiment, the image writing is started before the conveyance of the sheet is started and the toner image is formed on the intermediate transfer belt 17 before the sheet is fed from the cassette. Thus, the alignment of the paper with the toner image is performed by controlling the feed timing and the conveyance speed of the paper and synchronizing the toner image and the sheet.

A transfer time of the image transferred from a position of the photosensitive member 13Y irradiated with laser to the primary transfer roller 18Y is determined based on a distance Ld and an angular speed Vd of the photosensitive member 13Y. The distance Ld is a distance between a laser irradiating point of the photosensitive member 13Y and the primary transfer roller 18Y. Further, a time Td in which the image is moved on the photosensitive member 13Y will be Ld/Vd. The movement time of the image after the image is transferred onto the intermediate transfer belt 17 by the primary transfer roller 18Y (movement time Tb) is determined based on a distance Lb and a drive speed Vb. A distance Lb is a distance between the primary transfer roller 18Y and the transfer position where the image is transferred by the secondary transfer roller 29. The drive speed Vb is a surface speed of the intermediate transfer belt 17. The movement time Tb of the image will be Lb/Vb.

The conveyance time of the sheet 21 from the cassette 22 to the transfer position where the image is transferred by the secondary transfer roller 29 will be a sum of the following conveyance time for each conveyance section. The surface speed Vb of the intermediate transfer belt 17 is generally regarded as a processing speed Vb in the present invention. In FIG. 2, the conveyance speed of the sheet 21 is regarded as the same speed as the processing speed Vb. A conveyance time Tp is a time from when the sheet 21 is fed from the rear end of the cassette 22 in the sheet conveying direction until the sheet 21 is conveyed to the transfer position where the image is transferred by the secondary transfer roller 29. The time Tp will be (Ll+Lf+Lc+Lr)/Vb, where Ll is a distance between the rear end of the cassette 22 in the sheet conveying direction and the nip portion of the separation roller pair 26*a* and 26*b*, Lf is a distance between the nip portion of the separation roller pair 26*a* and 26*b* and the sensor 28, and Lc+Lr is a distance between the sensor 28 and the secondary transfer roller 29.

Thus, by starting the conveyance of the sheet 21 after time Td+Tb−Tp=Tg from the start of the image forming, the sheet 21 aligns with the toner image. The time between the start of the image forming and the start of the conveyance of the sheet 21 is denoted as Tg. A distance Lc is a section where the speed of the sheet 21 is controlled after the sheet 21 passes the sensor 28. In the section Lc, the speed of the sheet 21 can be either accelerated or decelerated. In the section Lr after the section Lc, the speed of the sheet 21 needs to be set to a speed same as the surface speed Vb of the intermediate transfer belt 17. FIG. 2 illustrates a relation of the toner image and the sheet 21 when neither a slip nor a double feeding is occurred.

Figure 3:
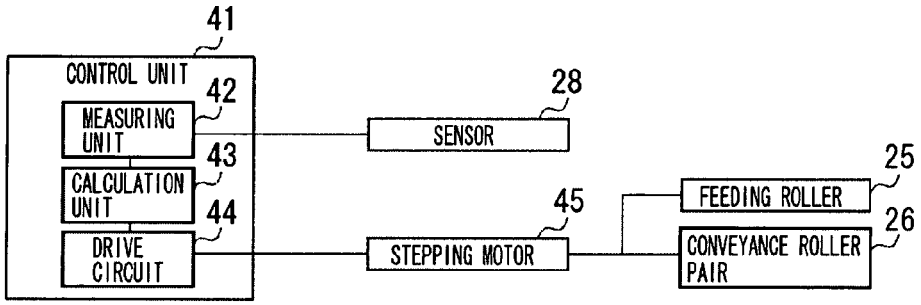
FIG. 3 illustrates an example configuration of a control unit according to an exemplary embodiment of the present invention.

Next, referring to FIGS. 1, 3, and 4, an alignment control of a position of the toner image and the sheet 21 in a processing speed Vbmax which is a maximum available processing speed of the image forming apparatus, will be described according to the first exemplary embodiment of the present invention. FIG. 3 illustrates a configuration of a control unit 41. The sensor 28 is connected to a measuring unit 42. The measuring unit 42 measures the conveyance time of the sheet 21 from the cassette 22 to the sensor 28. The measuring unit 42 is connected to a calculation unit 43. According to a measurement result obtained from the measuring unit 42, the calculation unit 43 calculates optimum conveyance speeds of the feeding roller 25 and the conveyance roller pair 27 and outputs the calculation result to a drive circuit 44 of the stepping motor 45 which drives the feeding roller 25 and the conveyance roller pair 27.

Figure 4:
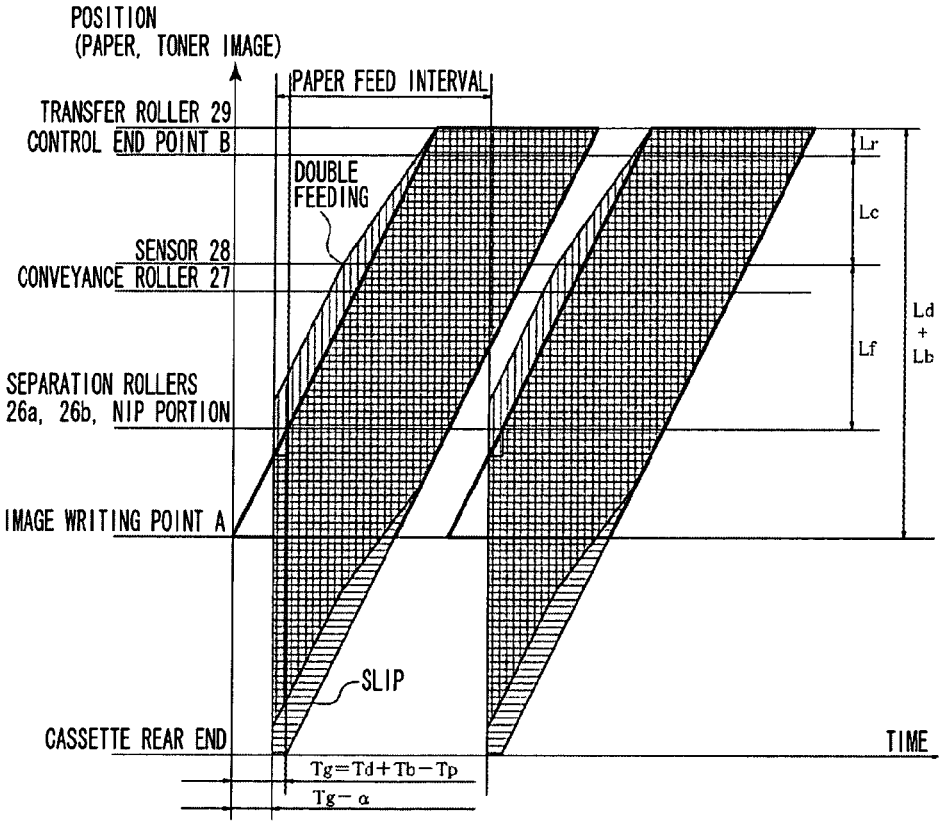
FIG. 4 illustrates an example alignment of a sheet with a toner image according to a first exemplary embodiment of the present invention.

FIG. 4 illustrates an alignment of the sheet 21 with the toner image formed on the intermediate transfer belt 17 when the processing speed of the image forming apparatus is the maximum processing speed. A thick line in FIG. 4 is a plot of the Y image which is formed on the photosensitive drum disposed at the most upstream side of the intermediate transfer belt 17. Areas shaded with vertical lines show that the sheet 21 is fed at timing earlier than desired timing (see FIG. 2). More specifically, these areas show a positional change of the sheet 21 when double feeding of the sheet 21 occurs in the cassette 22. On the other hand, areas shaded with horizontal lines show that the sheet 21 is fed at timing later than desired timing (see FIG. 2). More specifically, these areas show a positional change of the sheet 21 when a slip of the feeding roller 25 occurs in the cassette 22.

First, a basic operation of the conveyance of the sheet 21 will be described. The sheet 21 fed from the cassette 22 is conveyed to the sensor 28 at the same speed as the surface speed Vb of the intermediate transfer belt 17. In the meantime, the measuring unit 42 measures the time that the sheet 21 is conveyed from the cassette 22 to the sensor 28. According to the measurement result of the measuring unit 42, the speeds of the feeding roller 25 and the conveyance roller pair 27 are controlled while the sheet 21 is conveyed along the speed control section Lc (between the sensor 28 and the control end position) so that the sheet 21 is aligned with the toner image. After the sheet 21 passes the control end position, the speed of the sheet 21 will be adjusted to the speed same as the surface speed Vbmax of the intermediate transfer belt 17.

Next, the alignment of the sheet 21 with the toner image at the processing speed Vbmax which is the maximum processing speed of the image forming apparatus will be described in detail. When the image forming is started at the photosensitive member 13Y, the sheet 21 is fed from the cassette 22 time α earlier than the time Tg. As described above, the time Tg is a time from the start of the image forming to the start of the conveyance of the sheet 21. In other words, the conveyance of the sheet 21 from the cassette 22 is started at such timing that the sheet 21 reaches the transfer position where the image is transferred by the secondary transfer roller 29 time α earlier than the toner image. Here, a time Ts is a maximum acceptable paper conveyance delay time. The delay is caused by a slip of the feeding roller 25 in the cassette 22. Further, if a slip which corresponds to the maximum acceptable time Ts occurs, the time that the sheet 21 takes to be transferred from the cassette 22 to the sensor 28 will be measured by the measuring unit 42 to be the time Ts longer than when the slip does not occur. Accordingly, the time Ts needs to be adjusted in the speed control section Lc which is the section between the sensor 28 and the control end position.

However, since the conveyance of the sheet 21 precedes the toner image by time α, the correcting time needed for the alignment of the sheet 21 with the toner image will be Ts−α. If the normal conveyance speed in the speed control section Lc is Vb, then the conveyance time in the section Lc will be Lc/Vb, and to make up the delay time Ts−α, the sheet 21 needs to be conveyed along the speed control section Lc in time (Lc/Vbmax)−(Ts−α). The conveyance speed is thus obtained by the equation (1) below.

$$\text{Conveyance speed}=(Vb\max\times Lc)/((Lc-Vb\max\times(Ts-\alpha)) \quad (1)$$

Here, by setting the time α within a range of $0<\alpha\leq Ts$, a speed adjustment to the acceleration side in the speed control section Lc can be reduced. Further, where α=Ts, the speed adjustment becomes minimum and acceleration is unnecessary to the processing speed Vbmax.

The maximum processing speed Vbmax according to the present exemplary embodiment is a maximum processing speed of the image forming apparatus when an image is formed on a plain sheet. The image forming apparatus according to the present exemplary embodiment is capable of setting a processing speed slower than the processing speed Vbmax. For example, in a case where a thick sheet (a sheet which is thicker or has more grammage than a plain sheet) is processed, the processing speed is reduced to ½ the speed of the processing speed Vbmax. Further, in a case where a gloss sheet (a sheet which has a higher gloss level than a plain sheet) is processed, the processing speed is reduced to ¾ the speed of the processing speed Vbmax.

When the processing speed is ½ or ¾ the speed of the processing speed Vbmax, the paper feed of the sheet 21 is not started time α earlier as described above. In other words, if the start of the paper feeding of the sheet 21 when the processing speed is ½ or ¾ the speed of the processing speed Vbmax is regarded as reference timing, the present exemplary embodiment is characterized in that the paper feeding of the sheet is started time α earlier than the reference timing.

Further in FIG. 4, if the conveyance speed needs a significant amount of adjustment, the conveyance speed of the sheet 21 is changed sharply when the sheet 21 reaches the sensor 28 and when it reaches the control end point. If the conveyance speed is changed sharply, the step-out of the stepping motor 45 may occur. According to the present exemplary embodiment, the speed of the stepping motor 45 is controlled to gradually accelerate or decelerate and thus the step-out can be avoided. Since a speed curb of the acceleration/deceleration and the decelerated speed are set to recover the delay time Ts−α when the sheet is conveyed from the sensor 28 to the control end point, an effect similar to those of changing the speed sharply can be obtained. Since an effect similar to when the conveyance speed is rapidly changed can be obtained by the acceleration/deceleration of the stepping motor 45 of the exemplary embodiments described below, descriptions of the effect of the stepping motor 45 will be omitted.

According to the present exemplary embodiment, the increasing rate of the conveyance speed of the sheet 21 can be minimized. Thus, the alignment of the sheet 21 with the toner image is achieved while preventing the step-out of the stepping motor 45 which drives the feeding roller 25 and the conveyance roller pair 27 due to decreasing torque at a high speed area, and further, without increasing the size of the stepping motor 45.

Second Exemplary Embodiment

Figure 5:
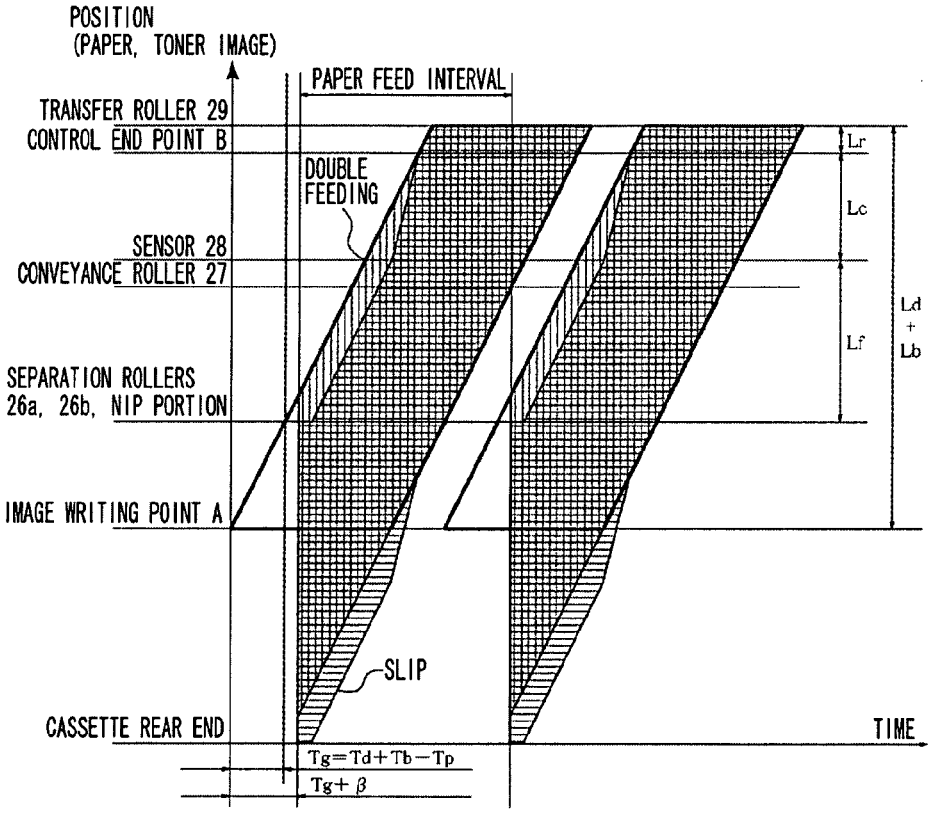
FIG. 5 illustrates an example alignment of a sheet with a toner image according to a second exemplary embodiment of the present invention.

According to a second exemplary embodiment, an alignment of a sheet 21 with a toner image is controlled when a processing speed of an image forming apparatus is a minimum processing speed Vbmin. Although the second exemplary embodiment is described referring to FIGS. 1, 3, and 5, descriptions of FIGS. 1 and 3 are omitted as they are described in the first exemplary embodiment. FIG. 5 illustrates the alignment of the sheet 21 with the toner image when the processing speed of the image forming apparatus is the minimum processing speed Vbmin.

A thick line in FIG. 5 is a plot of a Y image which is formed on the photosensitive drum disposed at the most upstream side of the intermediate transfer belt 17. Areas shaded with lines show that the sheet 21 is fed at timing earlier than desired timing (see FIG. 2). More specifically, these areas show a positional change of the sheet 21 when double feeding of the sheet 21 occurs in the cassette 22. On the other hand, areas shaded with horizontal lines show that the sheet 21 is fed at timing later than desired timing (see FIG. 2). More specifically, these areas show a positional change of the sheet 21 when a slip of the feeding roller 25 occurs in the cassette 22.

When the image forming is started at a photosensitive member 13Y, the sheet 21 is fed from the cassette 22 time β later than the time Tg. The time Tg is a time from the start of the image forming to the start of the conveyance of the sheet 21. In other words, conveyance of the sheet 21 from the cassette 22 is started at such timing that the sheet 21 reaches the transfer position where the image is transferred by the secondary transfer roller 29 time β later than the toner image. Here, a distance Ll is the maximum distance of double feeding in the cassette 22 which is the distance between the end of the cassette 22 in the paper conveying direction and the separation rollers 26*a* and 26*b*. The double feeding is a phenomenon where the top sheet in the cassette and the next sheet are conveyed together.

If a double feeding occurs with the maximum distance the time that the sheet 21 takes to be transferred from the cassette 22 to the sensor 28 will be as described below.

If the conveyance speed of the sheet 21 at the section Ll is a speed same as the minimum processing speed Vbmin, the sheet 21 will be measured by the measuring unit 42 Ll/Vbmin earlier than when the sheet 21 is conveyed without the double feeding. Thus, a time equal to Ll/Vbmin needs to be adjusted in the speed control section Lc which is a section from the sensor 28 to the control end position.

However, since the toner image precedes the sheet 21 by time β, the time needed to be adjusted for the alignment of the sheet 21 with the toner image will be Ll/Vbmin−β. If the normal conveyance speed in the speed control section Lc is Vbmin, then the conveyance time in the section Lc will be Lc/Vbmin. Thus, to adjust the time Ll/Vbmin−β in the section Lc, the sheet 21 needs to be conveyed in the speed control section Lc in a time (Lc/Vbmin)+(Ll/Vbmin−β). The conveyance speed is thus obtained by the equation (2) below.

$$\text{Conveyance speed}=(Vb\min\times Lc)/(Lc+Ll-Vb\min\times\beta) \quad (2)$$

Here, by setting the time β within a range of 0<β≤(Ll/Vbmin), a speed adjustment of the deceleration side in the speed control section Lc can be reduced. Further, where β=Ll/Vbmin, the speed adjustment becomes minimum and deceleration is unnecessary as to the processing speed Vbmin.

When the processing speed is ½ or ¾ the speed of the maximum processing speed Vbmax (which is described in the first exemplary embodiment), the paper feed of the sheet 21 is not started time β later as described above. In other words, if the start of the paper feeding of the sheet 21 when the processing speed is ½ or ¾ the speed of the maximum processing speed Vbmax is regarded as reference timing, the present exemplary embodiment is characterized in that the paper feeding of the sheet is started time β later than the reference timing.

According to the present exemplary embodiment, the decreasing rate of the conveyance speed of the feeding roller 25 and the conveyance roller pair 27 can be minimized. Thus, the alignment of the sheet 21 with the toner image can be achieved without generating vibration and noise of the stepping motor 45 which drives the feeding roller 25 and the conveyance roller pair 27 at a low speed area, and further use of a vibration absorber can be avoided.

Third Exemplary Embodiment

In a third exemplary embodiment, if the speed of the image forming apparatus is the maximum speed of a plurality of processing speeds, the sheet is fed at earlier timing and a range of speed controlled by a control unit which accelerates or decelerates a conveyance speed of the sheet 21 is shifted to the deceleration side. On the other hand, if the speed of the image forming apparatus is the minimum speed of the plurality of processing speeds, the sheet is fed at later timing and the range of speed controlled by the control unit which accelerates or decelerates the conveyance speed of the sheet 21 is shifted to the acceleration side. That is, control of the paper feed timing in the third exemplary embodiment is a combination of the first and the second exemplary embodiments.

Since the control of the alignment of the sheet 21 with the toner image at the maximum processing speed Vbmax and the minimum processing speed Vbmin are described in detail in the first and the second exemplary embodiments, descriptions on these controls will be omitted.

According to the present exemplary embodiment, the maximum processing speed Vbmax is 200 mm/s and the minimum processing speed Vbmin is 50 mm/s. When the processing speed is the maximum processing Vbmax, the drive frequency of the stepping motor 45 is 1000 pps. When the processing speed is the minimum processing speed Vbmin, the drive frequency of the stepping motor 45 is 250 pps. The speed control section Lc is 120 mm, the maximum acceptable paper conveyance delay time Ts caused by a slip of the feeding roller 25 in the cassette 22 is 100 ms, and the maximum distance of double feeding Ll of the sheet 21 is 30 mm. Further, if the paper feed timing of the sheet 21 is set the time α earlier than the timing when the processing speed is the maximum processing speed Vbmax, the conveyance speed for adjusting the maximum acceptable time Ts will be obtained by an equation (Vbmax×Lc)/((Lc−Vbmax×(Ts−α)). This equation is the same as the equation (1) in the first exemplary embodiment. Similarly, if the paper feed timing of the sheet 21 is set the time β later than the reference timing when the processing speed is the minimum processing speed Vbmin, then the conveyance speed for adjusting the maximum distance of double feeding Ll will be obtained by an equation (Vbmin×Lc)/(Lc+Ll−Vbmin×β). This equation is the same as the equation (2) in the second exemplary embodiment.

FIG. 6 illustrates speed adjustment ranges of the feeding roller 25, the conveyance roller pair 27, and the stepping motor 45 driving the feeding roller 25 and the conveyance roller pair 27 when the plurality of processing speeds include acceleration or deceleration of the feeding roller 25 and the conveyance roller pair 27 for the alignment of the sheet 21 with the toner image. The deceleration adjustment value at the maximum processing speed and the acceleration adjustment value at the minimum processing speed are omitted from the tables since these values do not affect the speed adjustment ranges of the feeding roller 25, the conveyance roller pair 27, and the stepping motor 45 driving the rollers 25 and 27. In other words, if the processing speed is such as ½ or ¾ the speed of the maximum processing speed Vbmax described in the first and the second exemplary embodiments, since the speed can be controlled within the range 50-200 mm/s, change of the conveyance timing becomes unnecessary even if a slip or a double feeding occurs.

A table (a) shows the speed adjustment range of the feeding roller 25, the conveyance roller pair 27, and the stepping motor 45 driving the feeding roller 25 and the conveyance roller pair 27 where α=β=0 ms or a case where the present exemplary embodiment is not implemented. As is the case where the processing speed is ½ or ¾ the speed of the maximum processing speed Vbmax, the conveyance timing of the sheet is not changed. In this case, the conveyance speed of the feeding roller 25 and the conveyance roller pair 27 will be 40-240 mm/s and the drive frequency of the stepping motor 45 driving the feeding roller 25 and the conveyance roller pair 27 will be 200-1200 pps.

A table (b) shows the speed adjustment range of the feeding roller 25, the conveyance roller pair 27, and the stepping motor 45 driving the feeding roller 25 and the conveyance roller pair 27 where α=50 ms and β=300 ms according to the present exemplary embodiment. In this case, the conveyance speed of the feeding roller 25 and the conveyance roller pair 27 will be 44-218 mm/s and the drive frequency of the stepping motor 45 driving the feeding roller 25 and the conveyance roller pair 27 will be 222-1091 pps.

A table (c) shows a minimum speed adjustment range of the feeding roller 25, the conveyance roller pair 27, and the stepping motor 45 driving the rollers 25 and the conveyance roller pair 27 where $\alpha$=100 ms and $\beta$=600 ms according to the present exemplary embodiment. In this case, the conveyance speed of the feeding roller 25 and the conveyance roller pair 27 will be 50-200 mm/s and the drive frequency of the stepping motor 45 driving the feeding roller 25 and the conveyance roller pair 27 will be 250-1000 pps.

As described above, by changing start timing of the conveyance of the sheet when the image forming apparatus is operated at the maximum or the minimum processing speed, the speed adjustment range of the stepping motor 45 can be set similar or equal to the range of 50-200 mm/s.

According to the present exemplary embodiment, the range of the drive frequency of the stepping motor 45 which drives the feeding roller 25 and the conveyance roller pair 27 can be narrowed. Accordingly, the range of the conveyance speed of the feeding roller 25 and the conveyance roller pair 27 can be minimized without reducing printing efficiency. Thus, the alignment of the sheet 21 with the toner image can be achieved without causing the step-out of the stepping motor 45 due to decreasing torque at a high speed area. Further, increase of the size of the stepping motor 45, generation of vibration and noise of the stepping motor 45 at a low speed area, and use of a vibration absorber can be avoided.

Fourth Exemplary Embodiment

According to a fourth exemplary embodiment, paper feed timing is controlled by a combination of following two cases. If a speed of the image forming apparatus is the maximum speed of a plurality of processing speeds, the conveyance speed of the sheet 21 is accelerated or decelerated to align the sheet 21 with the toner image. On the other hand, if a speed of the image forming apparatus is the minimum, the sheet 21 is fed at earlier timing and then stopped for a time at a predetermined point downstream of the sensor 28 in the paper conveyance direction by a stop of the conveyance roller pair 27. The stop time is depending on a time taken by the sheet 21 to be transferred from the paper feed to the sensor 28. Then, the conveyance of the sheet 21 by the conveyance roller pair 27 is restarted at timing ideal for the sheet 21 to be aligned with the toner image.

Descriptions of the alignment of the sheet 21 with the toner image by accelerating or decelerating the conveyance speed of the conveyance roller pair 27 when the image forming apparatus is at the maximum processing speed, will be omitted as they are described above in the first and the third exemplary embodiments.

Figure 7:
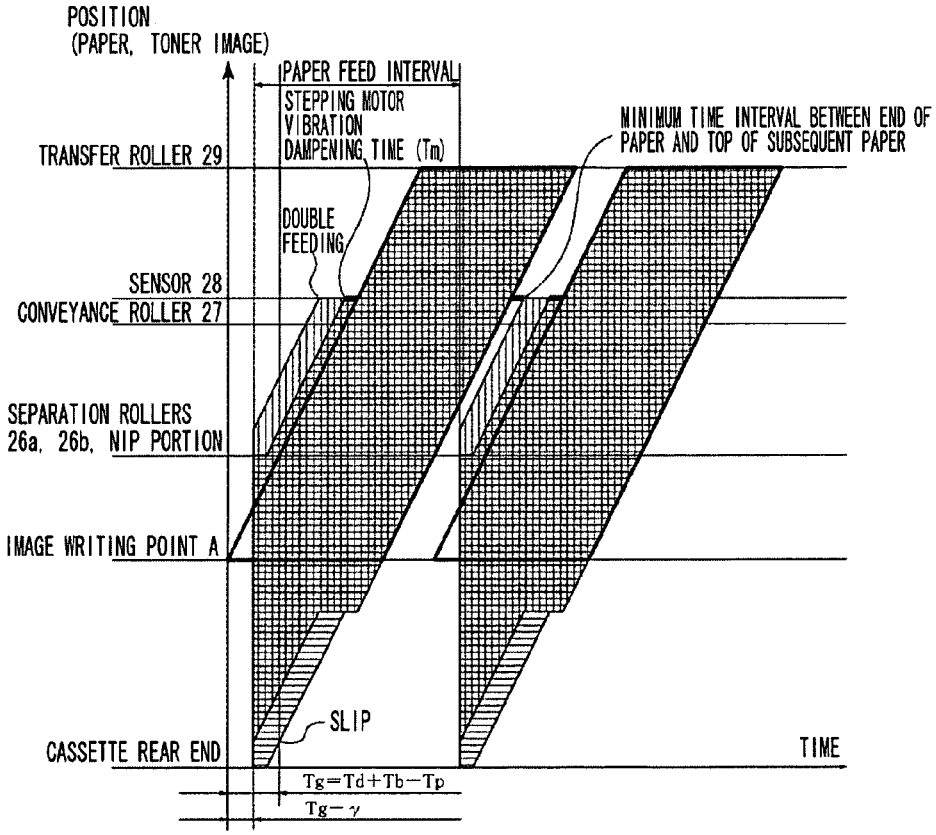
FIG. 7 illustrates an example alignment of a sheet with a toner image according to a fourth exemplary embodiment of the present invention.

FIG. 7 illustrates an alignment of the sheet 21 with a toner image if the speed of the image forming apparatus is the minimum processing speed, the sheet 21 is fed at earlier timing and then stopped for a time at a predetermined point downstream of the sensor 28 in the paper conveying direction by a stop of the conveyance roller pair 27 according to the time taken by the sheet 21 to be transferred from the paper feed to the sensor 28. Then, the conveyance of the sheet 21 by the conveyance roller pair 27 is restarted at timing ideal for the sheet 21 to be aligned with the toner image.

A thick line in FIG. 7 is a plot of a Y image which is formed on the photosensitive drum disposed at the most upstream side of the intermediate transfer belt 17. Areas shaded with vertical lines show that the sheet 21 is fed at timing earlier than desired timing. More specifically, these areas show a positional change of the sheet 21 when double feeding of the sheet 21 occurs in the cassette 22. On the other hand, areas shaded by horizontal lines show that the sheet 21 is fed at timing later than desired timing. More specifically, these areas show a positional change of the sheet 21 when a slip of the feeding roller 25 occurs in the cassette 22.

When the image forming is started at the photosensitive member 13Y, the sheet 21 is fed from the cassette 22 time $\gamma$ earlier than the time Tg. As described above, the time Tg is a time from the start of the image forming to the start of the conveyance of the sheet 21. In other words, the conveyance of the sheet 21 from the cassette 22 is started at such timing that the sheet 21 reaches the transfer position where the image is transferred by the secondary transfer roller 29 the time $\gamma$ earlier than the toner image. When the sensor 28 detects the sheet 21, the conveyance of the sheet 21 is stopped for a time. The conveyance of the sheet 21 is restarted at the minimum processing speed Vbmin at timing ideal for the sheet 21 to be aligned with the toner image. The length of a stop time of the sheet 21 is determined according to the time that the sheet 21 takes to be transferred from the cassette 22 to the sensor 28.

Next, the time $\gamma$ will be described. The stepping motor 45 which drives the feeding roller 25 and the conveyance roller pair 27 has a characteristic that it tends to step out if it is restarted before vibration generated by stoppage is not sufficiently reduced. Thus, the stepping motor 45 requires a relatively long stop time until the vibration is sufficiently reduced. If a length of time until the vibration is reduced is Tm, the maximum double feeding distance of the sheet 21 from the cassette 22 is Ll, a conveyance speed of the sheet 21 in the section Ll is the same as the minimum processing speed Vbmin, then the time $\gamma$ will be Tm+Ll/Vbmin. The conveyance speed of the sheet 21 in the section Ll can be faster than the minimum processing speed Vbmin.

According to the present exemplary embodiment, if the speed of the image forming apparatus is the maximum speed of a plurality of processing speeds, the sheet is fed at earlier timing, and a range of speed controlled by a control unit which accelerates or decelerates the conveyance speed of the feeding roller 25 and the conveyance roller pair 27 is shifted to the deceleration side. On the other hand, if the speed of the image forming apparatus is the minimum speed of the plurality of processing speeds, the sheet is fed at earlier timing, and the sheet 21 is stopped for a time at a predetermined position downstream of the sensor 28 in the paper conveyance direction. The stop time is depending on a time taken by the sheet 21 to be transferred from the paper feed to the sensor 28. The conveyance of the sheet 21 is restarted at timing ideal for the sheet 21 to be aligned with the toner image. An example combining the above cases will be described below.

According to the present exemplary embodiment, the maximum processing speed Vbmax is 200 mm/s and the minimum processing speed Vbmin is 50 mm/s. When the processing speed is the maximum processing Vbmax, the drive frequency of the stepping motor 45 is 1000 pps. When the processing speed is the minimum processing speed Vbmin, the drive frequency of the stepping motor 45 is 250 pps. The speed control section Lc is 120 mm and the maximum acceptable paper conveyance delay time Ts caused by a slip of the feeding roller 25 in the cassette 22 is 100 ms. Further, if the paper feed timing of the sheet 21 is set the time $\alpha$ earlier than the timing when the processing speed is the maximum processing speed Vbmax, then the conveyance speed for adjusting the maximum acceptable time Ts will be $(Vbmax \times Lc)/((Lc - Vbmax \times (Ts - \alpha))$. The conveyance speed will always be equal to the minimum processing speed Vbmin when the processing speed is the minimum processing speed Vbmin.

FIG. 8 illustrates speed adjustment ranges of the feeding roller 25, the conveyance roller pair 27, and the stepping motor 45 driving the feeding roller 25 and the conveyance roller pair 27 when the plurality of processing speeds include acceleration or deceleration of the feeding roller 25 and the conveyance roller pair 27 for the alignment of the sheet 21 with the toner image. The deceleration adjustment value at the maximum processing speed is omitted from the table since the adjustment value does not affect the speed adjustment ranges of the feeding roller 25, the conveyance roller pair 27, and the stepping motor 45 driving the rollers 25 and 27. Further, since the acceleration and deceleration adjustments are unnecessary when the processing speed of the image forming apparatus is the minimum processing speed, these adjustment values are not included in the tables in FIG. 8.

A table (a) shows the speed adjustment range of the feeding roller 25, the conveyance roller pair 27, and the stepping motor 45 driving the feeding roller 25 and the conveyance roller pair 27 where $\alpha$=0 ms or a case where the present exemplary embodiment is not applied. In this case, the conveyance speed of the feeding roller 25 and the conveyance roller pair 27 will be 40-240 mm/s and the drive frequency of the stepping motor 45 driving the feeding roller 25 and the conveyance roller pair 27 will be 200-1200 pps.

A table (b) shows the speed adjustment range of the feeding roller 25, the conveyance roller pair 27, and the stepping motor 45 driving the feeding roller 25 and the conveyance roller pair 27 where $\alpha$=50 ms according to the present exemplary embodiment. In this case, the conveyance speed of the feeding roller 25 and the conveyance roller pair 27 will be 50-218 mm/s and the drive frequency of the stepping motor 45 driving the feeding roller 25 and the conveyance roller pair 27 will be 250-1091 pps.

A table (c) illustrates a minimum speed adjustment range of the feeding roller 25, the conveyance roller pair 27, and the stepping motor 45 driving the rollers 25 and 27 where $\alpha$=100 ms according to the present exemplary embodiment. In this case, the conveyance speed of the feeding roller 25 and the conveyance roller pair 27 will be 50-200 mm/s and the drive frequency of the stepping motor 45 driving the feeding roller 25 and the conveyance roller pair 27 will be 250-1000 pps.

Figure 10:
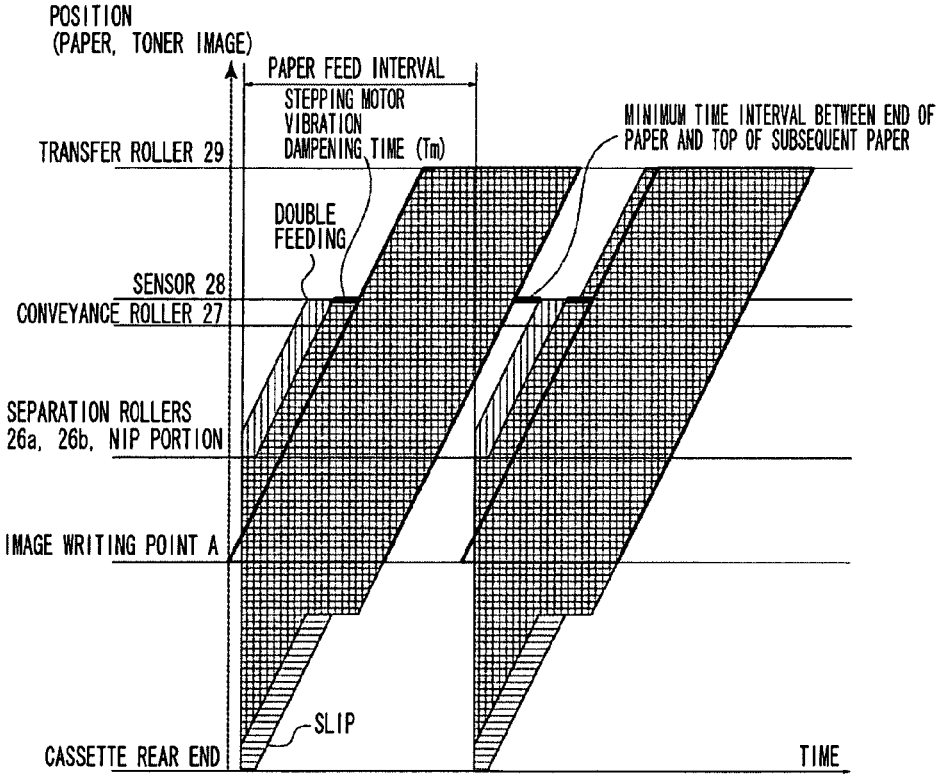
FIG. 10 illustrates an example conventional technique in aligning a sheet with a toner image by stopping a conveyance of the sheet for a time.
Figure 11:
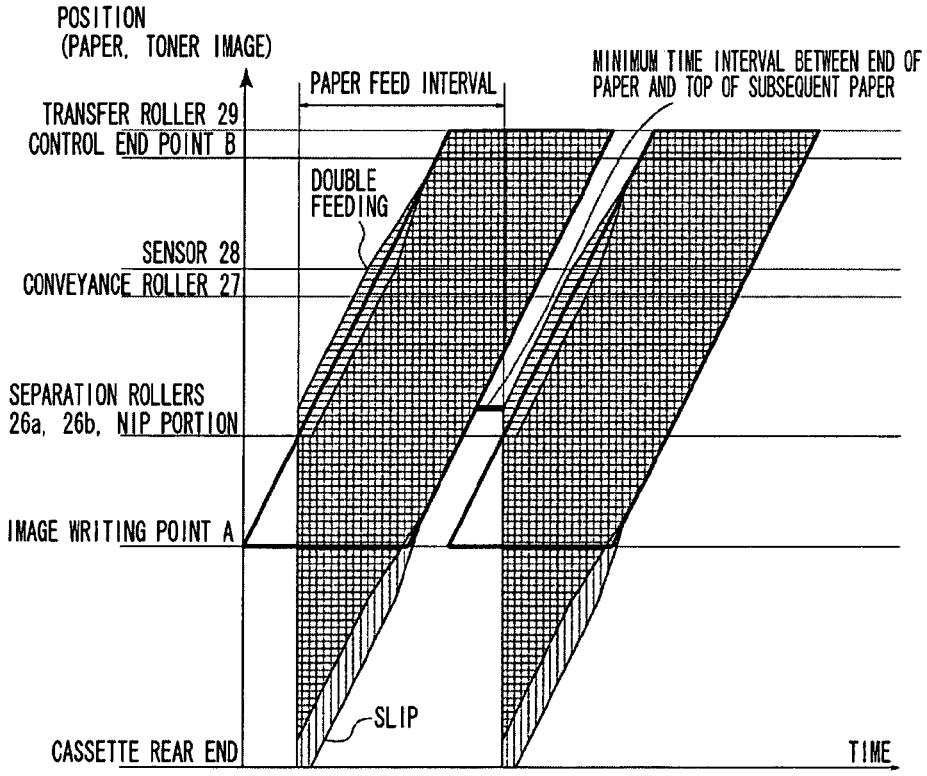
FIG. 11 illustrates an example conventional technique in aligning a sheet with a toner image without stopping a conveyance of the sheet.

Next, a relation between printing efficiency and an interval of the sheet 21 at continuous printing will be described. FIG. 10 illustrates a technique for aligning the sheet 21 with the toner image by stopping the conveyance of the sheet 21 for a time. FIG. 11 illustrates a technique for aligning the sheet 21 with a toner image without stopping the conveyance of the sheet 21. The former technique requires longer paper feed interval than the latter at least for the time the stepping motor 45 is stopped.

FIG. 9 illustrates differences of printing efficiencies depending on whether the stepping motor 45 is stopped or not—According to the present exemplary embodiment, the maximum processing speed Vbmax is 200 mm/s, the minimum processing speed Vbmin is 50 mm/s, the size of the sheet 21 in the conveying direction is 300 mm, the paper interval is 100 mm, and the time necessary in sufficiently reducing the vibration by the stop of the stepping motor 45 is 100 ms. The table shows that when the image forming apparatus is operated at the maximum processing speed and without the stop of the stepping motor 45, the time for forming the image on the sheet 21 is 1.5 second, the paper interval is 0.5 second, and the printing efficiency is 30 pages/sec.

On the other hand, when the image forming apparatus is operated at the maximum speed processing speed and with the stop of the stepping motor 45, the time for forming an image on the sheet 21 is 1.5 second, the paper interval is 0.5 second, and the stop time of the stepping motor 45 is 0.1 second. In this case, the printing efficiency is 28.5 pages/sec and so the printing efficiency is greatly reduced. However, at the minimum processing speed, the printing efficiency without the stop of the stepping motor 45 is 7.5 pages/sec while the printing efficiency with the stop of the stepping motor 45 is 7.4 pages/sec. That is, the stop time of the stepping motor 45 is decreased in proportion to the total processing time, therefore, the printing efficiency differs only in a minimal way (with the difference of only 0.1 page/sec) in the process with and without the stop of the stepping motor 45 at the minimum processing speed.

According to the present exemplary embodiment, by minimizing the reduction of printing efficiency, the range of the conveyance speed of the sheet 21 can be minimized even when the image forming apparatus is driven at a plurality of processing speeds. Thus, the alignment of the sheet 21 with the toner image can be achieved without causing the step-out of the stepping motor 45 due to decreasing torque at a high speed area, increasing the size of the stepping motor 45. Further, generation of vibration and noise of the stepping motor 45 at a low speed area, and use of a vibration absorber can be avoided.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-111933 filed Apr. 20, 2007, which is hereby incorporated by reference herein in its entirety.

What is claimed is:

1. An image forming apparatus capable of transferring an image, formed on an image carrier, onto a sheet at a plurality of image forming speeds, the image forming apparatus comprising:

a transfer unit configured to transfer the image formed on the image carrier onto the sheet at a transfer position;

a feed unit configured to feed the sheet;

a conveyance unit configured to convey the sheet fed from the feed unit to the transfer position, wherein the conveyance unit is configured to change a conveyance speed of the sheet without stopping the conveyance of the sheet in a conveyance path between the feed unit and the transfer position to synchronize the sheet with the image formed on the image carrier; and a control unit configured to control the feed unit, wherein, in a case where an image is formed at a fastest image forming speed of the plurality of image forming speeds, the control unit controls the feed unit to feed the sheet before a first predetermined time has passed since the image started to be formed at the fastest image forming speed, wherein the first predetermined time is a time calculated by subtracting a time from when the sheet is fed until the sheet, which is conveyed with the conveyance speed that is not changed from the fastest image forming speed, reaches the transfer position from a time from when the image starts to be formed at the fastest image forming speed until the image formed on the image carrier reaches the transfer position, wherein, in a case where an image is formed at a slowest image forming speed of the plurality of image forming speeds, the control unit controls the feed unit to feed the sheet after a second predetermined time has passed since the image started to be formed at the slowest image forming speed, and wherein the second predetermined time is a time calculated by subtracting a time from when the sheet is fed until the sheet, which is conveyed with the conveyance speed that is not changed from the slowest image forming speed, reaches the transfer position from a time from when the image starts to be formed at the slowest image forming speed until the image formed on the image carrier reaches the transfer position.

2. An image forming apparatus capable of transferring an image, formed on an image carrier, onto a sheet at a plurality of image forming speeds, the image forming apparatus comprising:

a transfer unit configured to transfer the image formed on the image carrier onto the sheet at a transfer position;

a feed unit configured to feed the sheet;

a conveyance unit configured to convey the sheet fed from the feed unit to the transfer position, wherein the conveyance unit is configured to change a conveyance speed of the sheet without stopping the conveyance of the sheet in a conveyance path between the feed unit and the transfer position to synchronize the sheet with the image formed on the image carrier; and a control unit configured to control the feed unit, wherein, in a case where an image is formed at a fastest image forming speed of the plurality of image forming speeds, the control unit controls the feed unit to feed the sheet before a first predetermined time has passed since the image started to be formed at the fastest image forming speed, wherein the first predetermined time is a time calculated by subtracting a time from when the sheet is fed until the sheet, which is conveyed with the conveyance speed that is not changed from the fastest image forming speed, reaches the transfer position from a time from when the image starts to be formed at the fastest image forming speed until the image formed on the image carrier reaches the transfer position, wherein, in a case where an image is formed at a slowest image forming speed of the plurality of image forming speeds, the control unit controls the feed unit to feed the sheet before a second predetermined time has passed since the image started to be formed at the slowest image forming speed, and performs control to stop the conveyance of the sheet when the sheet reaches the conveyance unit, and then restarts the conveyance of the sheet, wherein the second predetermined time is a time calculated by subtracting a time from when the sheet is fed until the sheet, which is conveyed with the conveyance speed that is not changed from the slowest image forming speed, reaches the transfer position from a time from when the image starts to be formed at the slowest image forming speed until the image formed on the image carrier reaches the transfer position.

3. The image forming apparatus according to claim 1, further comprising:

a photosensitive member;

an irradiation unit configured to irradiate the photosensitive member with light to form a latent image on the photosensitive member; and a development unit configured to develop the latent image formed on the photosensitive member, wherein the image carrier is an intermediate transfer member onto which the image developed by the development unit is to be transferred, and wherein the first predetermined time and the second predetermined time are set based on a distance from a position where the feed unit starts feeding a sheet to the transfer position and a distance from a position where the irradiation unit irradiates the photosensitive member with the light to the transfer position.

4. The image forming apparatus according to claim 3, wherein timing at which the irradiation unit irradiates the photosensitive member with the light is earlier than timing to start feeding the sheet.

5. The image forming apparatus according to claim 1, further comprising a sensor configured to detect the sheet in the conveyance path between the feed unit and the transfer position, wherein the conveyance unit controls the conveyance speed of the sheet to accelerate or decelerate in a conveyance path between the sensor and the transfer position according to a length of time that the sheet takes to be transferred from the feed unit to the sensor.

6. The image forming apparatus according to claim 1, wherein the image forming apparatus sets one image forming speed of the plurality of image forming speeds according to a type of the sheet, wherein the type of the sheet includes a plain sheet and a thick sheet thicker than the plain sheet, wherein, in a case where a sheet fed by the feed unit is a plain sheet, the image forming apparatus sets the fastest image forming speed of the plurality of image forming speeds, and wherein, in a case where a sheet fed by the feed unit is a thick sheet, the image forming apparatus sets the slowest image forming speed.

7. The image forming apparatus according to claim 1, wherein the image forming apparatus is configured to set the plurality of image forming speeds in advance.

8. The image forming apparatus according to claim 1, further comprising a cassette configured to store a sheet, wherein the feed unit feeds the sheet stored in the cassette, and wherein the conveyance unit is configured to convey the sheet fed by the feed unit while changing a conveyance speed without stopping the sheet in a shortest route from the cassette to the transfer position to synchronize the sheet with the image formed on the image carrier.

9. The image forming apparatus according to claim 1, further comprising:

a photosensitive member;

an irradiation unit configured to irradiate the photosensitive member with light to form a latent image on the photosensitive member; and a development unit configured to develop the latent image formed on the photosensitive member, wherein the image carrier is an intermediate transfer member onto which the image developed by the development unit is to be transferred, and wherein the first predetermined time is a time calculated by subtracting a time from when the sheet is fed until the sheet, which is conveyed with the conveyance speed that is not changed from the fastest image forming speed, reaches the transfer position from a time from when the irradiation unit starts to irradiate the photosensitive member with the light until the image transferred onto the intermediate transfer member reaches the transfer position, wherein the second predetermined time is a time calculated by subtracting a time from when the sheet is fed until the sheet, which is conveyed with the conveyance speed that is not changed from the slowest image forming speed, reaches the transfer position from a time from when the irradiation unit starts to irradiate the photosensitive member with the light until the image transferred onto the intermediate transfer member reaches the transfer position.

* * * * *